US006945597B1

(12) United States Patent
Brown et al.

(10) Patent No.: US 6,945,597 B1
(45) Date of Patent: Sep. 20, 2005

(54) COMBINATION INSTRUMENT STAND AND CHAIR

(76) Inventors: Timothy Allan Brown, 216 Williams Road, Ellershouse, Hants County, Nova Scotia (CA) B0N 1L0; Stephen Glenn West, 19 Williams Road, Ellershouse, Hants County, Nova Scotia (CA) B0N 1L0

( * ) Notice: Subject to any disclaimer, the term of this patent is extended or adjusted under 35 U.S.C. 154(b) by 0 days.

(21) Appl. No.: 10/960,802

(22) Filed: Oct. 7, 2004

(51) Int. Cl.[7] ..... A47C 7/62
(52) U.S. Cl. ..... 297/188.1; 297/181; 297/56
(58) Field of Search ..... 84/327; 248/443; 297/181, 129, 118, 188.08, 188.09, 188.1, 297/55, 56–57, 16.1, 188.04, 331, 336; D6/358, D6/388

(56) References Cited

U.S. PATENT DOCUMENTS

| | | | | |
|---|---|---|---|---|
| 1,568,477 | A * | 1/1926 | Small | 297/55 |
| 2,934,131 | A * | 4/1960 | Wenger | 297/186 |
| 3,014,760 | A * | 12/1961 | Gard | 297/188.08 |
| D255,297 | S * | 6/1980 | Miller | D6/358 |
| 4,550,950 | A * | 11/1985 | Fleishman | 297/440.13 |
| 4,793,654 | A * | 12/1988 | Takafuji | 297/338 |
| 5,029,796 | A | 7/1991 | Schoenig | |
| D355,773 | S | 2/1995 | MacOwan | |
| 6,462,260 | B2 | 10/2002 | Fediakov | |
| 6,585,315 | B1 | 7/2003 | Vail | |

FOREIGN PATENT DOCUMENTS

| | | |
|---|---|---|
| CA | 2349632 | 4/2003 |

* cited by examiner

*Primary Examiner*—Milton Nelson, Jr.
(74) *Attorney, Agent, or Firm*—MacMillan, Sobanski & Todd, LLC

(57) ABSTRACT

A combination instrument stand and chair includes a support device including a first and second pair of leg members movable from a first substantially parallel closed position to a second opened position with the first and second pairs of leg members forming an angle. A seat is attached to the support device for pivotal movement relative to the support means. A back supporting device is positioned in a vicinity of a distal end of the support device relative to the first pair of leg members. A seat supporting device is connected to the support means and movable between a folded position and a raised position. The seat supporting device has at least one musical instrument support bracket pivotably attached thereto.

23 Claims, 9 Drawing Sheets

COMBINATION INSTRUMENT STAND AND CHAIR

FIELD OF THE INVENTION

The present invention relates, generally, to a instrument stand which can be easily converted into a chair. More specifically, the present invention relates to an instrument stand, capable of supporting any instrument with a body and neck in an upright position which can be converted into a chair for the musician to sit on.

BACKGROUND OF THE INVENTION

Musicians, in particular those musicians who play stringed instruments having a neck and body, are often burdened by their instrument especially in an informal setting. Stringed instruments with a body and neck are often very cumbersome and expensive, so they cannot be safely placed on the ground when not in use for fear that they may be accidently damaged. Therefore, most musicians will also bring with them a stand to store the instrument in an upright position when not in use. In addition to transporting their instrument and a stand for their instrument, most musicians will also be required to travel with some form of stool or chair to sit on during the performance. However, in many circumstances bringing several items to a "gig" can be impractical or even impossible depending on the space available for transportation. Moreover, space can be limited at the site of the gig and in some cases additional items brought to the performance may have to be concealed. Therefore, traveling with an instrument stand and some form of seating apparatus is impractical or impossible.

To address some of these concerns, portable and lightweight stands have been developed that can be easily transported with the instrument. U.S. Pat. Nos. 5,029,796, 6,533,228 and 6,462,260 all disclose collapsible musical instrument stands, which take up less space and/or are lighter then conventional musical instrument stands. However, none of these prior art references describe musical instrument stands that can also be used by the musician as a seat during a performance. U.S. Design Pat. No. 355,773 illustrates a stool designed to accommodate a musical instrument with a body and neck, by having a neck support permanently provided on the seat of the stool and brackets for the base of the instrument attached to the legs of the stool. Although U.S. Design Pat. No. 355,773 provides a combined musical instrument stand and stool, the device is not easily transportable and the supports for the musical instrument are permanently attached to the stool, which in some cases could interfere with the usability of the stool.

U.S. Pat. No. 6,585,315 discloses a foldable stool and stringed instrument stand, wherein the seat of the stool is designed to provide a rest for the neck of the instrument and supports are provided on each of the front legs of the stool to support the body of the guitar. Although U.S. Pat. No. 6,585,315 provides a portable combined stool and stringed instrument stand, the device has to provided with a seat height sufficient enough to support the neck of the instrument, which can make sitting on the stool during a performance uncomfortable. In addition, a back is not provided on the stool which will lead to fatigue for the musician during long performances. Furthermore, the foldable stool and musical instrument cannot be placed in a conventional container, such as a guitar case, for transportation on airplanes, trains, buses or the like.

SUMMARY OF THE INVENTION

It is an object of the present invention to provide a combination instrument stand and chair that overcomes the limitations of the prior art. In particular, the present invention provides a combination instrument stand and chair, which can hold any number of instruments with a body and neck and can be concealed into chair with a back. In addition, the combination instrument stand and chair of the present invention can also be transported in a conventional guitar case without modification to either the combination instrument stand and chair or the case.

According to one aspect of the present invention, there is provided a combination instrument stand and chair, comprising support means comprising a first and second pair of leg members movable from a first substantially parallel closed position to a second opened position with the first and second pairs of leg members forming an angle; a seat attached to the support means for pivotal movement relative to the support means; a back supporting means positioned in a vicinity of a distal end of the support means relative to the leg members; a seat supporting means connected to the support means and moveable between a folded position and a raised position, the seat supporting means having at least one musical instrument support bracket pivotably attached thereto, wherein in the raised position, the seat is supported by the seat supporting means in a substantially horizontal position, and in the folded position at least one musical instrument bracket is pivoted to an open position in which the musical instrument bracket provides support to a bottom of a musical instrument; and the seat is folded towards the support means.

Although any musical instrument with a body and neck could be held upright by the combination instrument stand and chair of the present invention, those instruments that will be well suited include any stringed instrument with a body and neck, excluding a harp. Accordingly, the back and seat of the combination instrument stand and chair can be provided in shapes representing the instrument it is intended to hold.

DETAILED DESCRIPTION OF THE INVENTION

Figure 1:
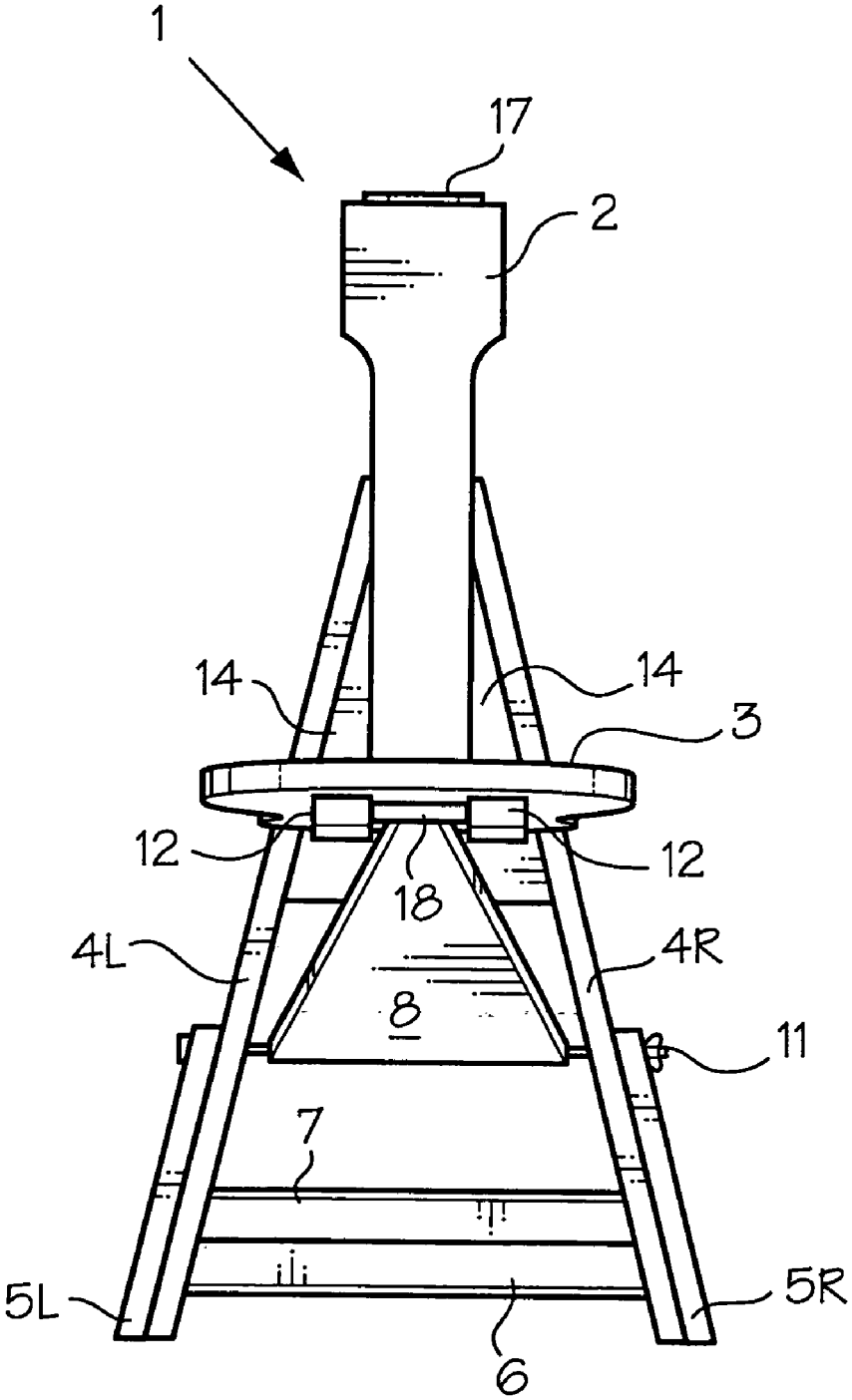
FIG. 1 Front view of the combination instrument stand and chair according to a first embodiment of the present invention.
Figure 2:
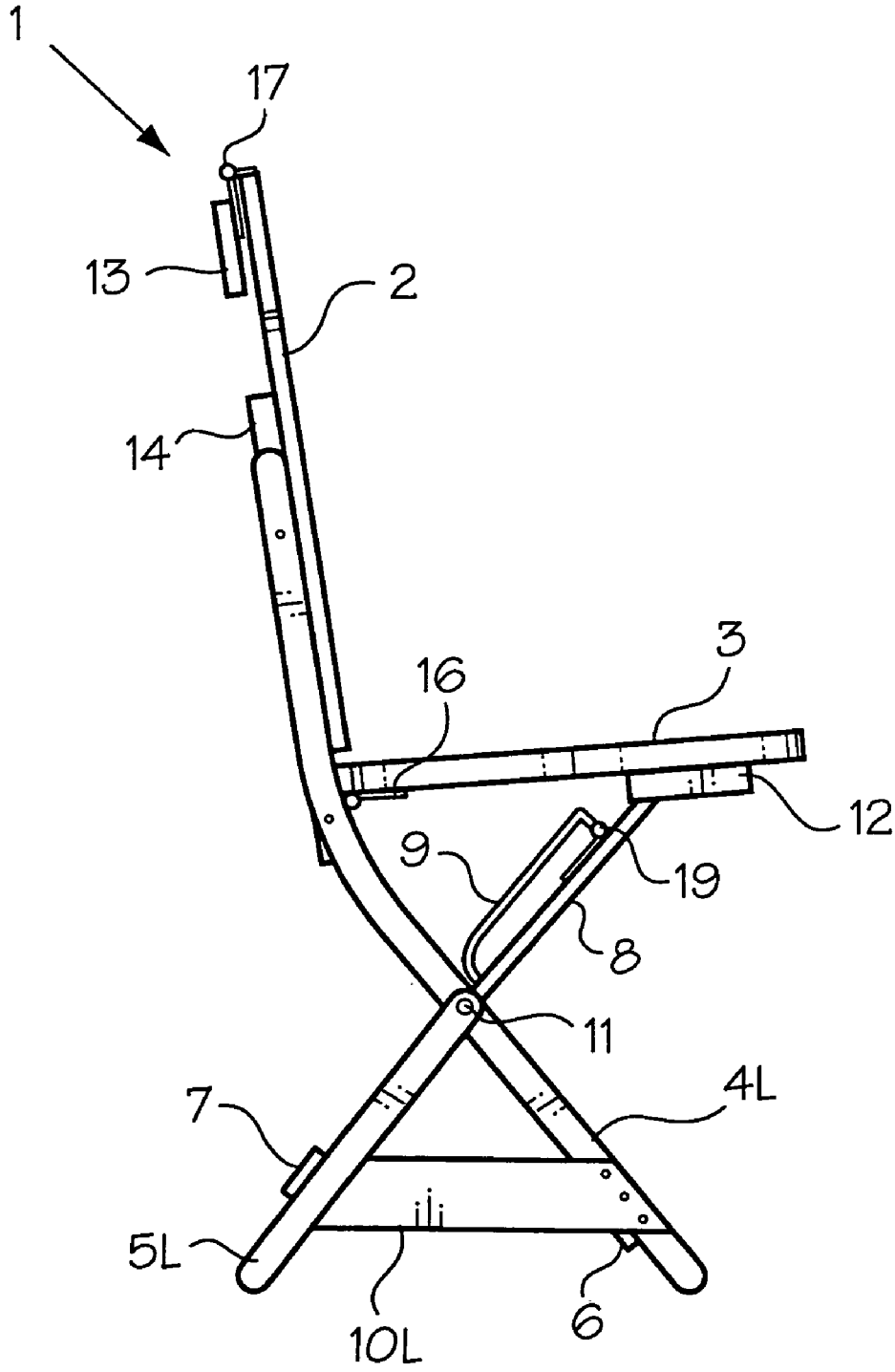
FIG. 2 Side view of the combination instrument stand and chair shown in FIG. 1.
Figure 3:
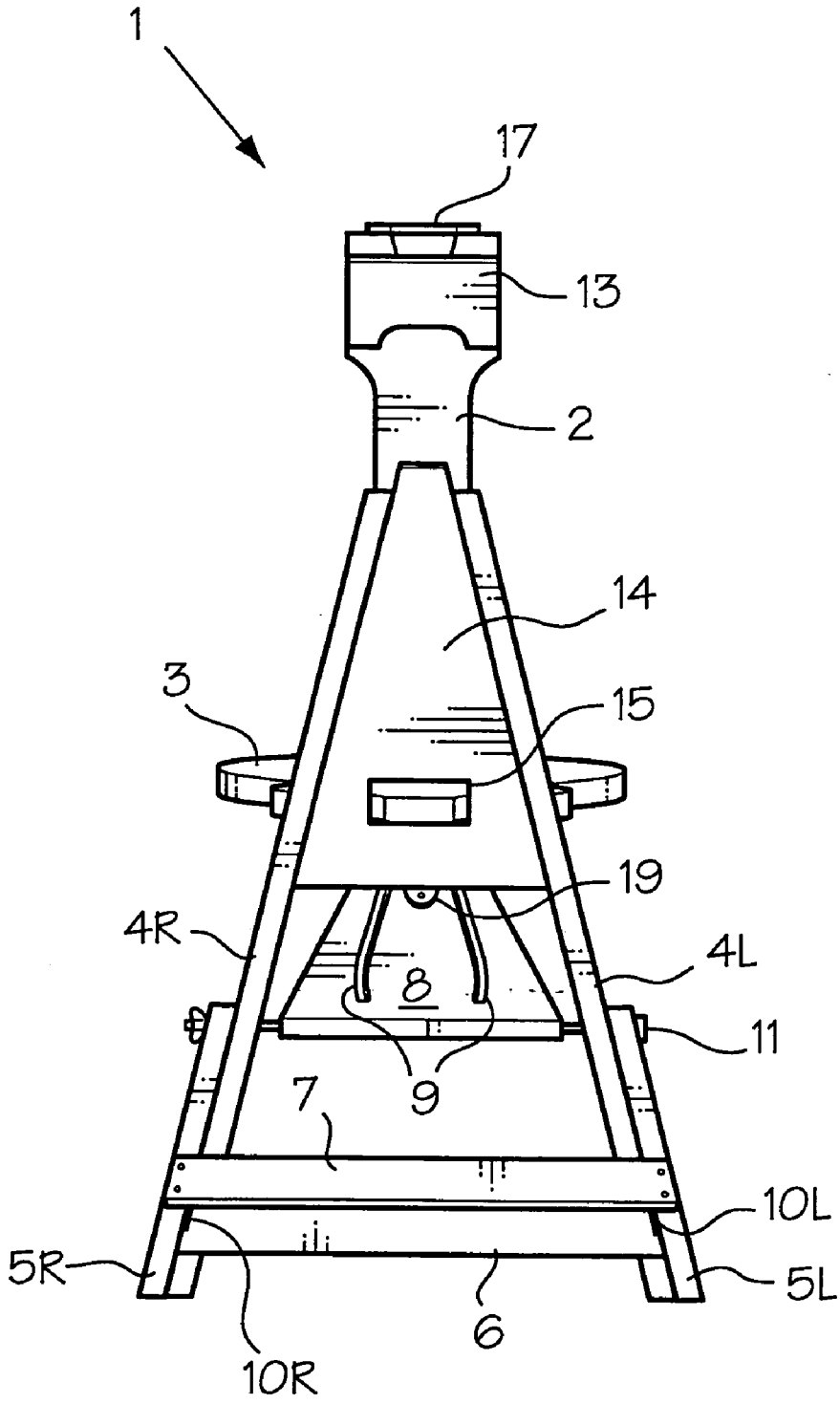
FIG. 3 Back view of the combination instrument stand and chair shown in FIG. 1.
Figure 4:
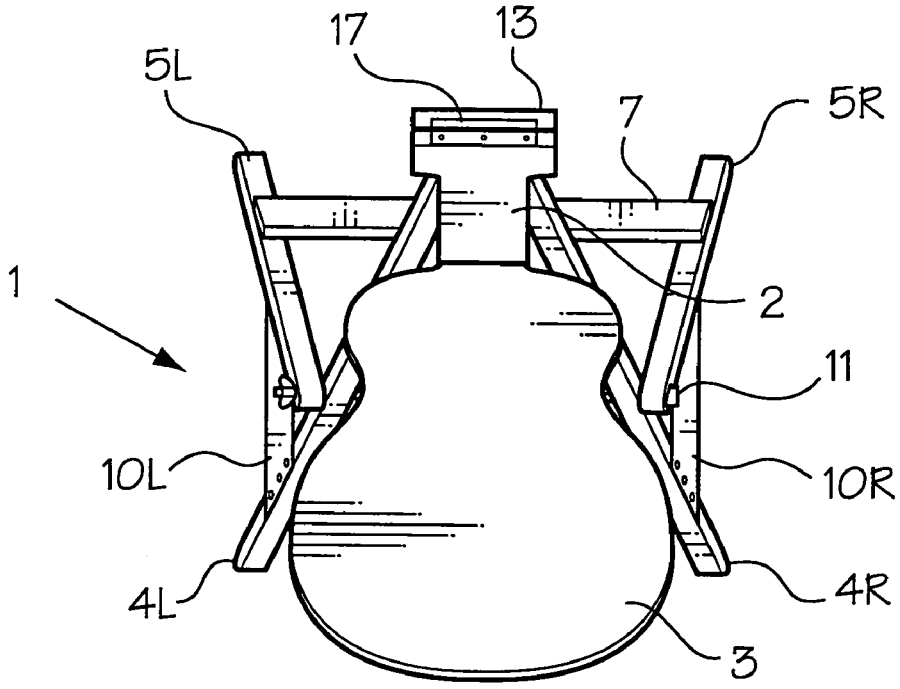
FIG. 4 Top plan view of the combination instrument stand and chair shown in FIG. 1.
Figure 5:
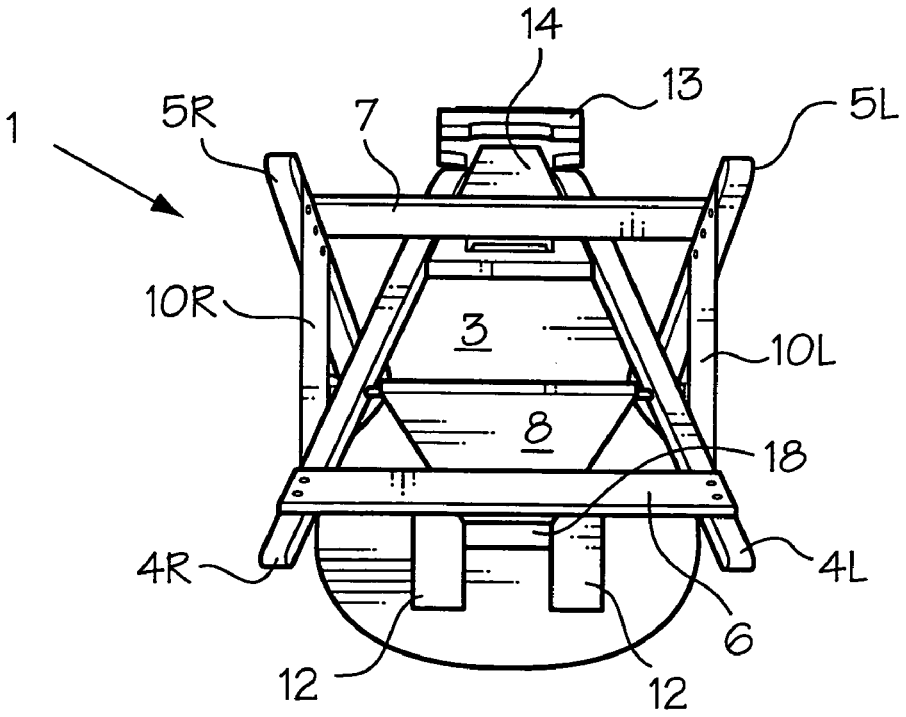
FIG. 5 Bottom view of the combination instrument stand and chair shown in FIG. 1.
Figure 6:
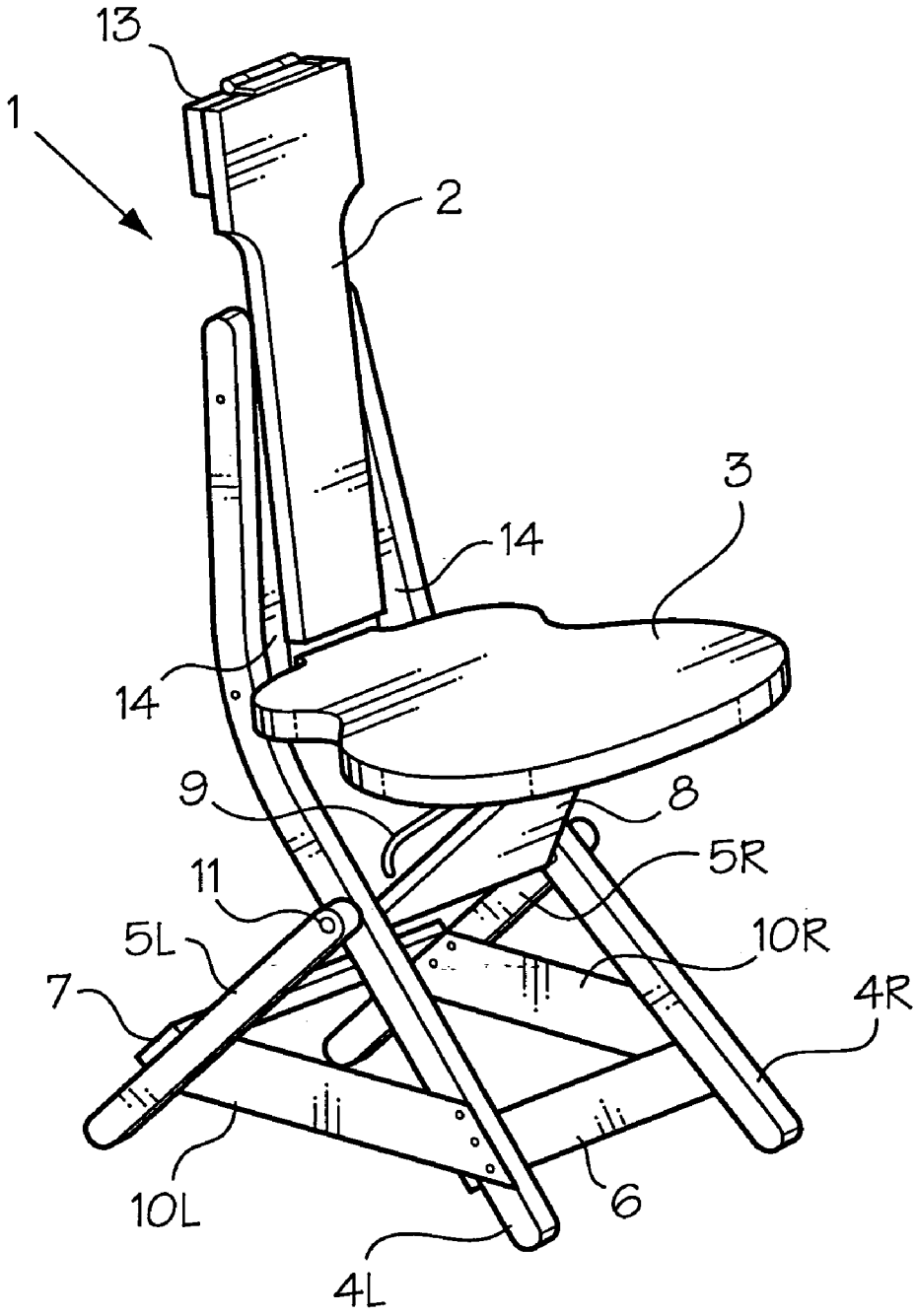
FIG. 6 Perspective view of the combination instrument stand and chair shown in FIG. 1.

Although other applications may be envisioned for the combination instrument stand and chair of the present invention, such as a music stand or drum stand. Accordingly, without intending to limit the present invention to the embodiments described herein, the invention will be described below in further detail having regard to the combination instrument stand and chair shown in FIGS. 1 to 10.

FIGS. 1 to 9 show a combination instrument stand and chair 1 with first pair of leg members 4*l*, 4*r* and second pair of leg members 5*l*, 5*r* in positions to support the combination instrument stand and chair 1 as either an instrument stand or a chair. To support the combination instrument stand and chair 1 as either an instrument stand or a chair, second pair of leg members 5*l*, 5*r* are rotated about rod 11, which interconnects second pair of leg members 5*l*, 5*r*, first pair of leg members 4*l*, 4*r* and seat supporting means 8, away from first pair of leg members 4*l*, 4*r*. The maximum distance in which second pair of leg members 5*l*, 5*r* can rotate away from first pair of leg members 4*l*, 4*r* is provided by first and second leg member supports 10*l* and 10*r*, which connect second leg member 5*l* and first leg member 4*l*; and second leg member 5*r* and first leg member 4*r*, respectively. In addition to first and second leg member supports 10*l* and 10*r*, lateral stability is also provided by first leg members support 6, which connects first leg members 4*l* and 4*r*; and second leg members support 7, which connects second leg members 5*l* and 5*r*. First leg members support 6 and second leg members support 7 are provided as rigid materials, such as wood or metal, whereas first and second leg member supports 10*l* and 10*r* are made of similar flexible materials or solid materials with a pivot point in the middle. The first pair of leg members 4*l*, 4*r* are substantially longer than the second pair of leg members 5*l*, 5*r*, and extend towards the back 2 of the combination instrument stand and chair 1. Provided between the one end of the first pair of leg members 4*l*, 4*r* adjacent to the back 2 is an backpiece 14 (shown in FIGS. 3 and 9). The first pair of leg members 4*l*, 4*r* are disposed on opposite sides of the backpiece 14. An opening 15 provided in the backpiece 14 allows for the seat 3 to rotate between a raised position substantially parallel to the ground and a folded position substantially parallel with said seat supporting means 8. Typically, the combination instrument stand and chair 1 of the present invention is constructed out of wood, however, any material that can sufficiently support the weight of a person will be suitable. Moreover, the various elements of the combination instrument stand and chair 1 of the present invention can be provided in different materials.

Typically, the second pair of leg members 5*l*,5*r* are connected to the first pair of leg members 4*l*, 4*r* via a rod 11 that projects horizontally through the second pair of leg members 5*l*,5*r*, first pair of leg members 4*l*,4*r* and the seat supporting means 8. Alternatively, any form of connector that allows the second pair of leg members 5*l*,5*r* and the seat supporting means 8 to pivot relative to the first pair of leg members 4*l*,4*r* will suffice.

A seat supporting means 8 is connected to the support means below the seat 3 for moving between a folded position and raised position. In the folded position the seat supporting means 8 is in substantial contact with the first pair of leg members support 6. In the raised position, the seat supporting means 8 engages the seat 3 to support the seat 3 in a substantially horizontal position. The seat supporting means 8 engages the seat 3 at a distal end of the seat supporting means 8 relative to the support means. A back supporting means is positioned in a vicinity of a distal end of the support means relative to the first leg members 4*l*,4*r*. The back supporting means can comprise the first pair of leg members 4*l*, 4*r* which are extended past the seat 3 of the combination instrument stand and chair 1. Furthermore, the combination instrument stand and chair 1 can comprise a separate back 2, which is connected to a distal end of the support means relative to the leg members 4*l*,4*r*. The back 2 is typically an elongated vertical structure. Preferably, the back 2 of the combination instrument stand and chair 1 is provided in a shape simulating the shape of the neck and head of a traditional acoustic guitar. However, the shape and height of the back 2 can be adjusted in order to accommodate a variety of musical instruments with a body and neck.

FIGS. 1 to 6 show a combination instrument stand and chair 1 according to a first arrangement of the present invention. The combination instrument stand and chair 1 is shown in FIGS. 1 to 6 configured as a chair. Typically, the seat 3 is attached to the support means by a hinge 16, which allows for the seat 3 to be folded towards the support means. However, any device that allows the seat 3 to move relative to the support means can replace the hinge 16. In a preferred embodiment, the seat 3 pivots by the force of gravity to a position substantially parallel with the seat supporting means 8 in a folded position. Alternatively, a channel can be provided in the seat 3 that allows the seat 3 to pivot towards the support means, which positions the seat 3 in substantial contact with said support means at the distal end of the support means relative to the first leg members 4*l*,4*r*.

Typically, one or more seat support stops are provided on the side of the seat 3 closest to the seat supporting means 8. The seat support stops engage the distal end of the seat supporting means 8 relative to the support means to support the seat 3 in a substantially horizontal position. Depending on which seat support stop the seat supporting means 8 engages, the horizontal position of the chair can be adjusted. These adjustments allow for the user to position the seat 3 at an angle suitable to his or her comfort. Preferably, the seat support stops are provided as two blocks 12 positioned at a distance parallel to one another, with rigid members 18 connecting the two blocks 12. In this case, the seat supporting means 8 engages the rigid members 18 to support the seat 3 in a substantially horizontal position. However, any structure or material can form the seat support stop, as long as it can physically engage the seat supporting means 8 to support the seat 3 in a substantially horizontal position. Alternatively, one or more recesses can be disposed on the side of the seat 3 closest to the seat supporting means 8 which will engage the seat supporting means 8 when the seat supporting means 8 is in the raised position.

To provide additional support to the seat 3 when in a substantially horizontal position, the end of the seat 3 closest to the support means can be provided with a protrusion which will engage a stop provided on the support means. Typically, an opening in the backpiece 14 or support means will act as the stop to engage the protrusion provided on the seat 3. The only limitation on the shape of the seat 3 is that it should be provided so a person can comfortably and safely sit on it. As a preferred embodiment, the seat 3 will be provided in the shape of a musical instrument body. Preferably, the seat 3 is provided in the hourglass shape of a traditional acoustic guitar body.

The musical instrument neck support 13 provides lateral support for the neck of a musical instrument. Preferably, the musical instrument neck support 13 is connected to the back 2 at a distal end of the back 2 relative to the leg members 4*l*,4*r*. Alternatively, the musical instrument neck support 13 is connected to a distal end of the support means relative to the leg members 4*l*,4*r* or is connected to the seat 3 at a distal end of the seat 3 relative to the support means. Typically, the musical instrument neck support 13 is connected to the back 2, support means or seat 3 by a hinge 17 which allows the musical instrument neck support 13 to move into a position capable of supporting a neck of a musical instrument.

Figure 7:
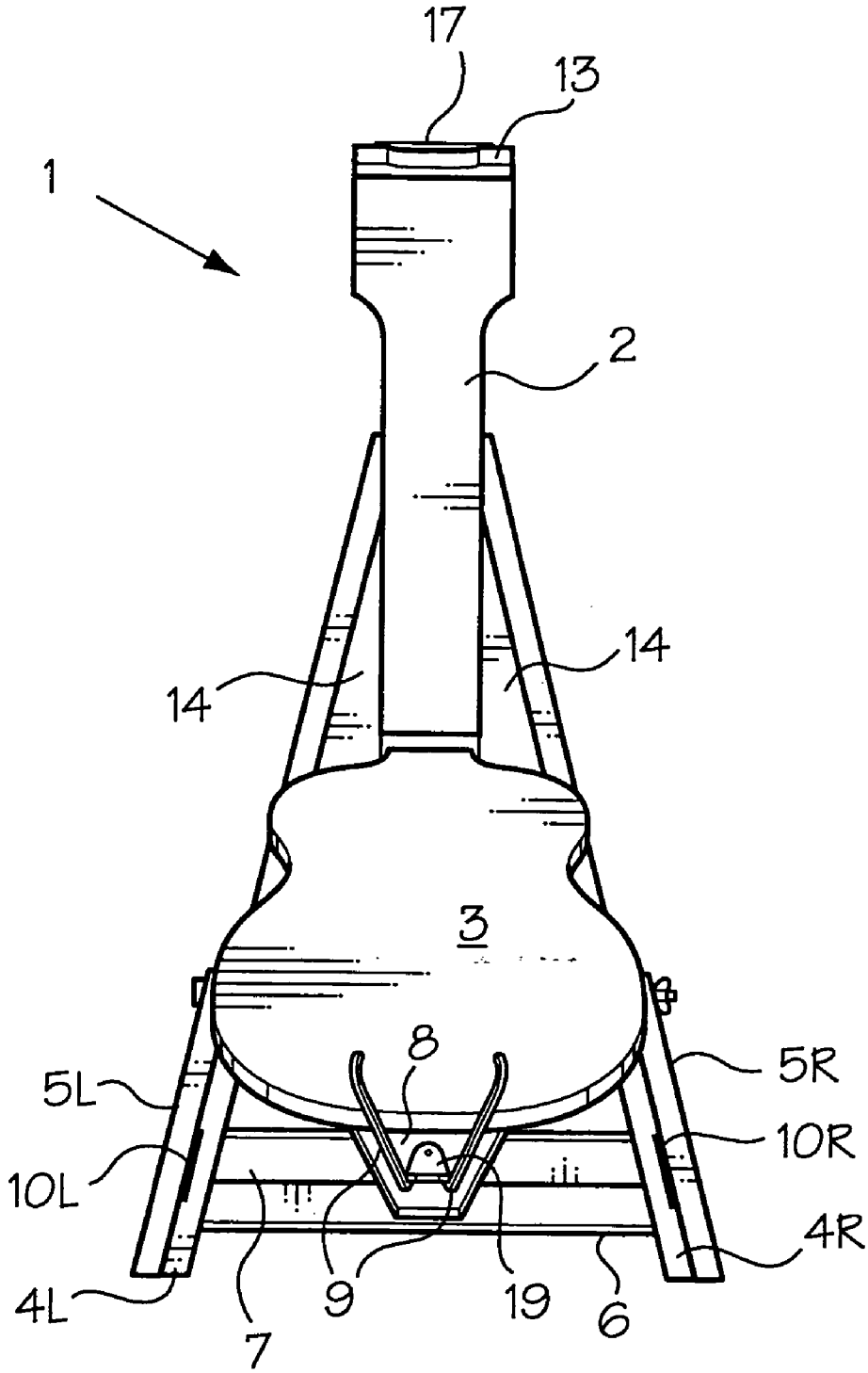
FIG. 7 Front view of the combination instrument stand and chair according to a second embodiment of the present invention.
Figure 8:
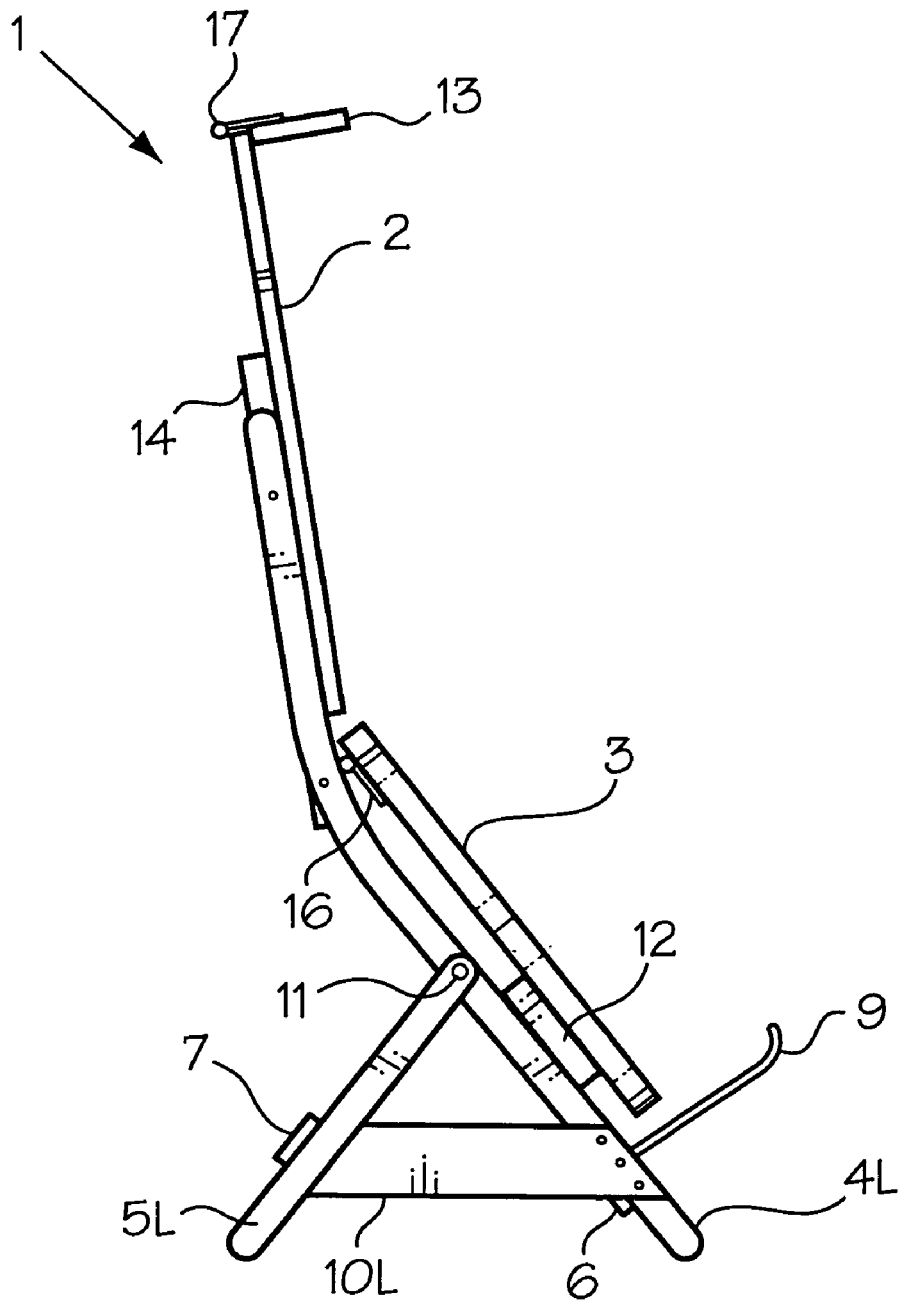
FIG. 8 Side view of the combination instrument stand and chair shown in FIG. 7.
Figure 9:
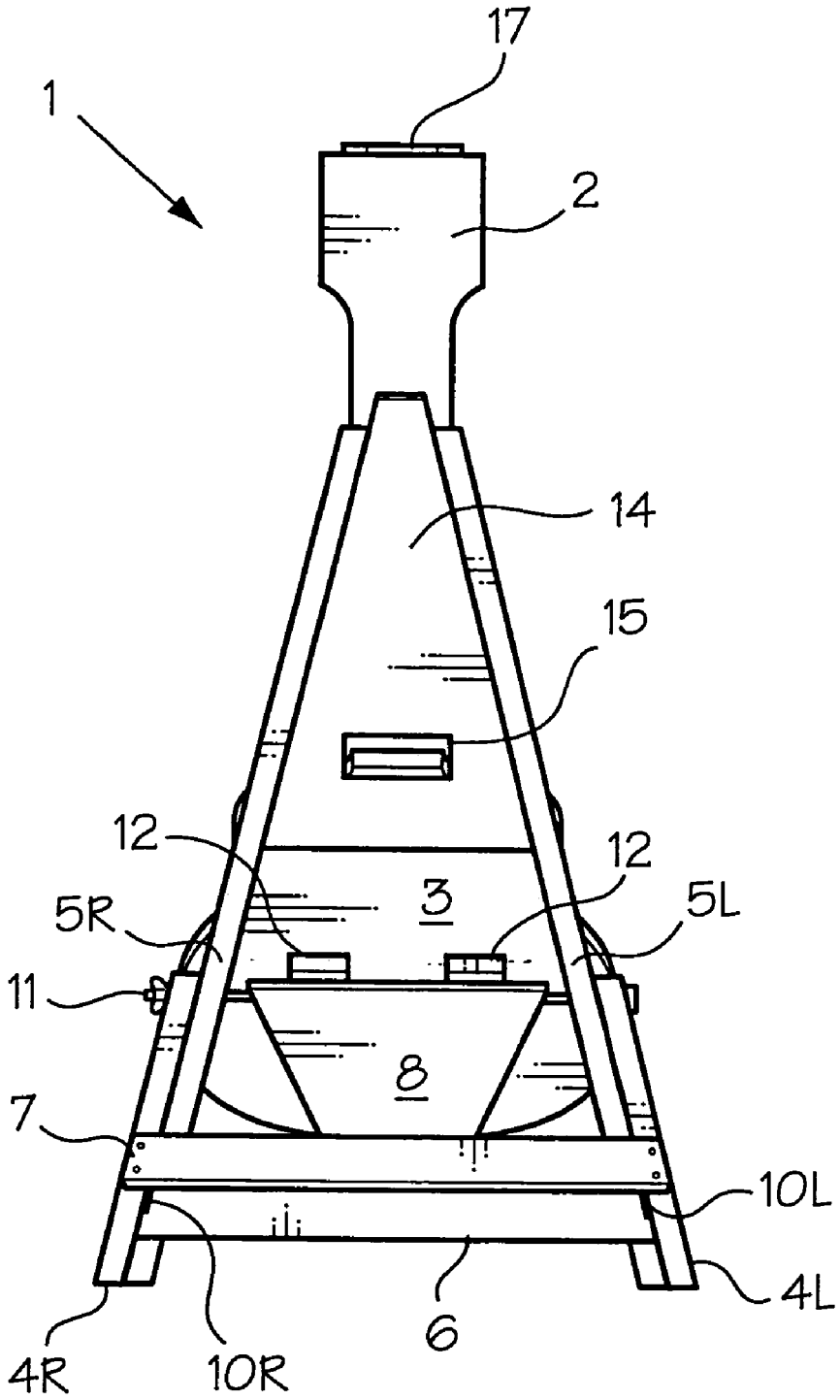
FIG. 9 Back view of the combination instrument stand and chair shown in FIG. 7.

In a second arrangement of the present invention, the combination instrument stand and chair 1 is converted from a chair, as shown in FIGS. 1 to 6, to an instrument stand, as shown in FIGS. 7 to 9. To convert into an instrument stand, seat supporting means 8 is disengaged from seat support stop and rotated about rod 11 to a position, wherein the end of the seat support 8 that was engaged with the seat support stop is now in substantial contact with first pair of leg members support 6. Musical instrument support bracket 9 is rotated about musical instrument support hinge 19 from a position substantially parallel to seat supporting means 8 to a position substantially perpendicular to seat support 8. The musical instrument support bracket 9 is pivotally attached to the seat supporting means 8. In the folded position at least one musical instrument bracket 9 is pivoted to an open position in which the musical instrument bracket 9 provided support to a bottom or base of a musical instrument. With seat supporting means 8 disengaged from seat support stop, the seat 3 will rotate downward about seat hinge 16, to a position substantially parallel with seat supporting means 8. Support for the neck of the instrument is provided by musical instrument neck support 13 which is rotated from a position parallel to and disposed on the back 2 opposite to the seat 3 of the combination instrument stand and chair 1 to position perpendicular to the back 2 on the same side as the seat 3.

Figure 10:
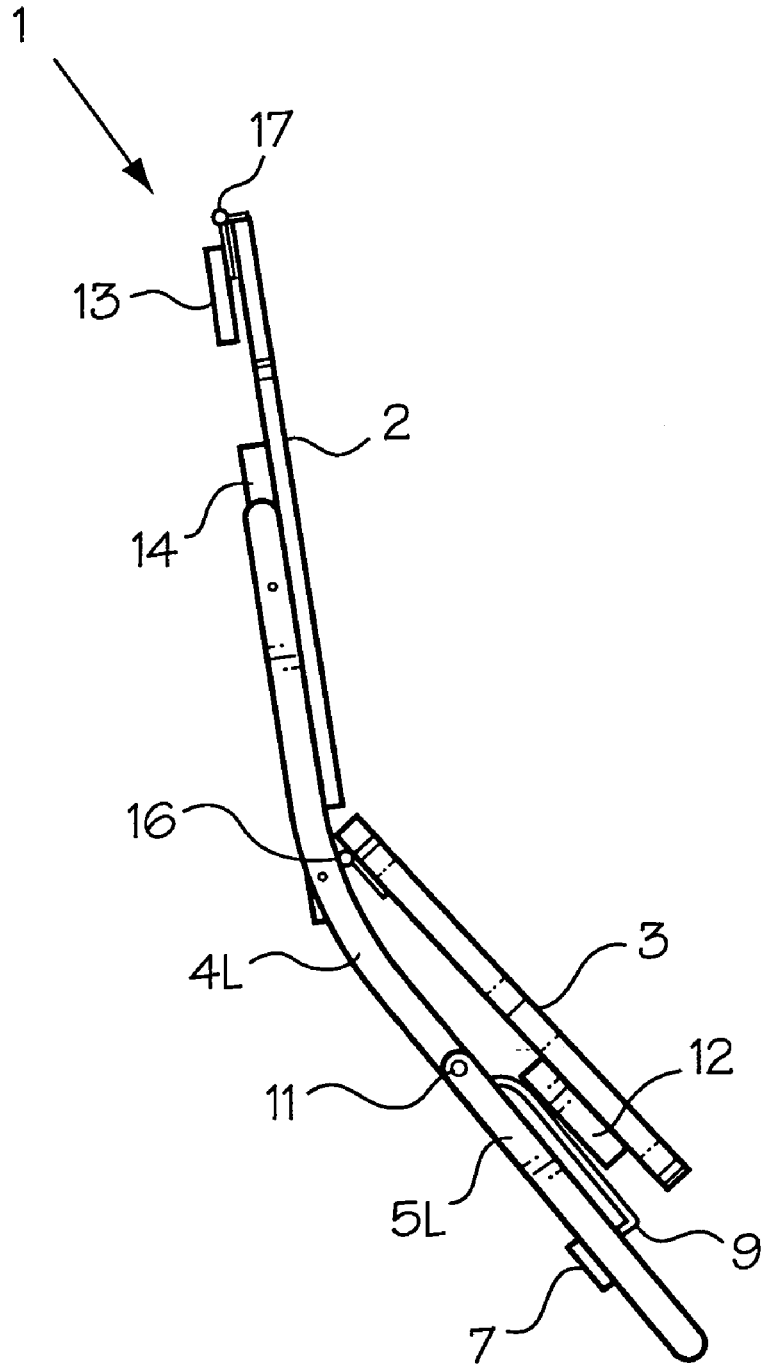
FIG. 10 Side view of the combination instrument stand and chair according to a third embodiment of the present invention.

A third arrangement of the present invention is shown in FIG. 10. In this arrangement the combination instrument stand and chair 1 can be folded substantially flat for easy transport and storage. To fold the combination instrument stand and chair 1 into the transport and storage configuration, seat 3 is manually lifted to allow for musical instrument support bracket 9 to be rotated about musical instrument support bracket hinge 19 from a position substantially perpendicular to the seat supporting means 8 to a position substantially parallel to the seat supporting means 8. Seat 3 is then positioned in substantial contact with first pair of leg members 4*l*, 4*r*. Musical instrument neck support 13 is rotated about musical instrument neck support hinge 17 from a position perpendicular to the back 2 on the same side as the seat 3 to a position parallel and disposed on the back 2 opposite to the seat 3. Second pair of leg members 5*l*, 5*r* are rotated about rod 11 from the second opened position wherein the first pair of leg members 4*l*, 4*r* and second pair of leg members 5*l*, 5*r* form an angle to the first substantially parallel closed position wherein the second pair of leg members 5*l*, 5*r* and first pair of leg members 4*l*, 4*r* are adjacent and aligned laterally.

The combination instrument stand and chair 1 of the present invention provides an economical and easy to use alternative for providing a musician with a portable device that can safety store a musical instrument in an upright position as well as provide the musician with a place to sit during a performance.

We claim:

1. A combination instrument stand and chair, comprising support means comprising a first and second pair of leg members movable from a first substantially parallel closed position to a second opened position with the first and second pairs of leg members forming an angle; a seat attached to said support means for pivotal movement relative to the support means; a back supporting means positioned in a vicinity of a distal end of the support means relative to the first pair of leg members; a seat supporting means connected to the support means and movable between a folded position and a raised position, said seat supporting means having at least one musical instrument support bracket pivotably attached thereto, wherein in said raised position, said seat is supported by said seat supporting means in a substantially horizontal position, and in the folded position said at least one musical instrument support bracket is pivoted to an open position in which said at least one musical instrument support bracket provides support to a bottom of a musical instrument; and said seat is folded towards said support means.

2. A combination instrument stand and chair according to claim 1, wherein said first pair of leg members is substantially longer than said second pair of leg members.

3. A combination instrument stand and chair according to claim 1, wherein said first pair of leg members is connected to said second pair of leg members.

4. A combination instrument stand and chair according to claim 1, wherein supports are provided between said first pair of leg members and between said second pair of leg members.

5. A combination instrument stand and chair according to claim 1, wherein further supports are provided between said first pair of leg members and said second pair of leg members.

6. A combination instrument stand and chair according to claim 5, wherein the supports are made of flexible material.

7. A combination instrument stand and chair according to claim 1, wherein the back supporting means comprises said first pair of leg members.

8. A combination instrument stand and chair according to claim 1, wherein a back is connected to a distal end of the support means relative to the first pair of leg members.

9. A combination instrument stand and chair according to claim 8, wherein the back is provided as an elongated vertical structure.

10. A combination instrument stand and chair according to claim 9, wherein the back is provided in a shape of a musical instrument neck.

11. A combination instrument stand and chair according to claim 1, wherein a musical instrument neck support is provided and moveable to support a neck of a musical instrument.

12. A combination instrument stand and chair according to claim 11, wherein said musical instrument neck support is connected to a distal end of said support means relative to said first pair of leg members.

13. A combination instrument stand and chair according to claim 11, wherein said musical instrument neck support is connected to a distal end of a back relative to said first pair of leg members.

14. A combination instrument stand and chair according to claim 11, wherein a musical instrument neck support is connected to a distal end of the seat relative to said support means.

15. A combination instrument stand and chair according to claim 1, wherein the seat is provided in a shape of a musical instrument body.

16. A combination instrument stand and chair according to claim 1, wherein said seat supporting means is connected to said support means at one end by a rod which interconnects said first leg members, said second leg members and said seat supporting means.

17. A combination instrument stand and chair according to claim 1, wherein said seat supporting means engages said seat in the raised position.

18. A combination instrument stand and chair according to claim 17, wherein said seat supporting means directly engages said seat by inserting the distal end of said seat supporting means relative to said support means into any one of a plurality of recesses disposed on a side of said seat in the vicinity of said seat supporting means.

19. A combination instrument stand and chair according to claim 17, wherein said seat supporting means indirectly engages said seat by engaging the distal end of said seat supporting means relative to said support means with any one of a plurality of seat support stops disposed on a side of said seat closest to said seat supporting means.

20. A combination instrument stand and chair according to claim 1, wherein in the raised position, said seat can support weight.

21. A combination instrument stand and chair according to claim 1, wherein in the folded position, said seat is folded towards said support means and is substantially parallel with said seat supporting means.

22. A combination instrument stand and chair according to claim 21, wherein in the folded position, said musical instrument support bracket can support a musical instrument.

23. A combination instrument stand and chair according to claim 1, wherein in the folded position, said seat is folded towards said support means and is in substantial contact with said support means at the distal end of said support means relative to said first pair of leg members.

* * * * *